US009951304B2

(12) United States Patent
Letzelter et al.

(10) Patent No.: US 9,951,304 B2
(45) Date of Patent: Apr. 24, 2018

(54) CLEANING PACK

(71) Applicant: The Procter & Gamble Company, Cincinnati, OH (US)

(72) Inventors: Nathalie Sophie Letzelter, Trimdon (GB); Nikola Curcic, Newcastle upon Tyne (GB); Elena Alda, Newcastle upon Tyne (GB); Karen Margaret Preston, Newcastle upon Tyne (GB); Robby Renilde Francois Keuleers, Lippelo (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 14/103,973

(22) Filed: Dec. 12, 2013

(65) Prior Publication Data

US 2014/0179586 A1 Jun. 26, 2014

(30) Foreign Application Priority Data

Dec. 21, 2012 (EP) ..... 12199243

(51) Int. Cl.

| | |
|---|---|
| ***C11D 17/00*** | (2006.01) |
| ***C11D 17/04*** | (2006.01) |
| ***B65B 3/02*** | (2006.01) |

(52) U.S. Cl.

CPC ..... *C11D 17/0039* (2013.01); *B65B 3/02* (2013.01); *C11D 17/043* (2013.01); *C11D 17/045* (2013.01)

(58) Field of Classification Search

None

See application file for complete search history.

(56) References Cited

U.S. PATENT DOCUMENTS

| | | | |
|---|---|---|---|
| 3,933,672 | A | 1/1976 | Bartolotta et al. |
| 4,136,045 | A | 1/1979 | Gault et al. |
| 4,765,916 | A | 8/1988 | Ogar et al. |
| 4,810,410 | A | 3/1989 | Diakun |
| 4,972,017 | A | 11/1990 | Smith et al. |
| 5,114,611 | A | 5/1992 | Van Kralingen et al. |
| 5,227,084 | A | 7/1993 | Martens et al. |
| 5,246,612 | A | 9/1993 | Van Dijk et al. |
| 5,452,216 | A | 9/1995 | Kellett |

(Continued)

FOREIGN PATENT DOCUMENTS

| | | |
|---|---|---|
| WO | WO 99/23211 A1 | 5/1999 |
| WO | WO 00/50550 A2 | 8/2000 |

(Continued)

OTHER PUBLICATIONS

U.S. Appl. No. 14/103,917, filed Dec. 12, 2013, Letzelter, et al.

(Continued)

*Primary Examiner* — Necholus Ogden, Jr.

(74) *Attorney, Agent, or Firm* — Abbey A. Lopez

(57) ABSTRACT

Multi-compartment water-soluble pack comprising a cleaning composition and an enveloping material where the pack comprises a first compartment containing a first composition in liquid form comprising:

i) a hygroscopic material; and ii) more than about 15% of water;

wherein the first composition has an equilibrium relative humidity of less than about 65% at 20° C.

8 Claims, 1 Drawing Sheet

(56) References Cited

U.S. PATENT DOCUMENTS

| | | | | |
|---|---|---|---|---|
| 5,612,305 | A | 3/1997 | Lewis | |
| 5,698,504 | A | 12/1997 | Christie et al. | |
| 5,766,371 | A | 6/1998 | Bunch et al. | |
| 6,093,562 | A | 7/2000 | Bisgard et al. | |
| 6,297,038 | B1 | 10/2001 | Bisgangrd-Frantzen et al. | |
| 6,403,355 | B1 | 6/2002 | Hagihara et al. | |
| 6,599,871 | B2 | 7/2003 | Smith | |
| 6,638,748 | B2 | 10/2003 | Hatada et al. | |
| 6,727,215 | B2 | 4/2004 | Roberts et al. | |
| 6,878,679 | B2 | 4/2005 | Sommerville-Roberts et al. | |
| 6,995,125 | B2 | 2/2006 | Dasque et al. | |
| 7,153,818 | B2 | 12/2006 | Breves et al. | |
| 7,259,134 | B2 | 8/2007 | Beckholt et al. | |
| 8,455,422 | B2 | 6/2013 | Sommerville-Roberts et al. | |
| 2002/0137648 | A1 | 9/2002 | Sharma et al. | |
| 2002/0198125 | A1 | 12/2002 | Jones | |
| 2003/0092590 | A1 | 5/2003 | Dasque et al. | |
| 2004/0259749 | A1 | 12/2004 | Braeckman et al. | |
| 2005/0003982 | A1* | 1/2005 | Beckholt et al. | 510/293 |
| 2008/0193999 | A1 | 8/2008 | Andersen et al. | |
| 2011/0053820 | A1 | 3/2011 | Souter et al. | |
| 2011/0266169 | A1 | 11/2011 | Catlin et al. | |
| 2012/0225450 | A1 | 9/2012 | Lang | |
| 2012/0240961 | A1 | 9/2012 | Denome et al. | |
| 2012/0252708 | A1 | 10/2012 | Van Lare et al. | |
| 2013/0217607 | A1* | 8/2013 | Souter et al. | 510/220 |

FOREIGN PATENT DOCUMENTS

| | | | |
|---|---|---|---|
| WO | WO00/60060 | A2 | 10/2000 |
| WO | WO 2010/067054 | A1 | 6/2010 |

OTHER PUBLICATIONS

"Chapter 6: Foam control in Detergent Products" (Ferch et al), "Defoaming, Theory and Industrial Applications", Ed., P.R. Garrett, Marcel Dekker, N.Y., 1973, 48 pages.

"Chapter 8: Surfactant Antifoams" (Blease et al), "Defoaming, Theory and Industrial Applications", Ed., P.R. Garrett, Marcel Dekker, N.Y., 1973, 25 pages.

EP Search Report; 12199236.6-1357; 5 Pages.

* cited by examiner

CLEANING PACK

TECHNICAL FIELD

The present invention is in the field of cleaning. It relates to a cleaning product, in particular a cleaning product in the form of a multi-compartment water-soluble pack comprising at least one compartment containing an aqueous composition.

BACKGROUND OF THE INVENTION

The detergent formulator is constantly facing cleaning and stability issues. Unit dose products can be more challenging than loose powders or liquids. Detergents in unit dose form have associated constrains in terms of volume that imply limitations in terms of the amount of actives.

Most if not all the cleaning ingredients can be susceptible to degradation to a greater or lesser extent. In unit dose products the different ingredients are in close proximity to one another this can negatively affect the stability of the product. The current trend is to reduce the size of the unit dose product making the cleaning and stability issues more of a challenge.

In recent years cleaning and stability of cleaning products have been impacted by the tendency to eliminate phosphate from cleaning formulations. Phosphate is not only an excellent cleaning active but also contributes to product stability by adsorbing moisture from the surrounding environment and/or from the product itself.

Another added complication that the detergent formulator faces is that different actives can be in different physical forms, some of them are in liquid form and some other in solid form. In order to have a cleaning composition in one physical form processing of ingredients in a different form is required. For example, organic dispersants such as organic polymers and organic builders are usually synthesized in liquid form. A great deal of work and high cost is associated with the transformation of these materials into particles in order to introduce them into products in solid form.

For example, a great deal of work has been done to convert organic polymers into particles. US 2012/0225450 A1 relates to carboxyl-containing polymer in solid form. These polymers are usually synthesized in aqueous solution. WO2011/133483 relates to a particle comprising an organic builder, in particular an aminocarboxylate builder. Aminocarboxylate builders are usually synthesized in aqueous solution.

The usual form in which aminocarboxylate and other dispersants, for example salts of glutamic acid N,N-diacetic acid (GLDA), methyl glycine diacyl acid (MGDA) are available is as liquid solutions with different active content. After drying the solution, the powder or granules, especially when obtained in the amorphous state, usually show hygroscopic and deliquescent properties which make them difficult to use in detergents. Moreover, the granules obtained from a granulation process (such as fluid bed granulation) are somewhat brittle and thus cannot grow easily to the required size, resulting in slow processing and lots of fines. In addition, whether in powder or granule form, the material can exhibit hygroscopic and deliquescent properties, and this will render the material sticky and thus introduce storage, handling, and manufacturing problems. These problems can be more acute in the case of dispersants such as aminocarboxylic acids and organic polymers. WO2011/076769 A1 addresses the problem by providing a process to make coated GLDA particles.

Flow properties of particles are critical in many ways. During manufacture of the particles themselves, they must flow smoothly relative to one another, e.g. in a fluid bed. Additionally, they must then be successfully transported to storage and transport containers. Finally, they must again be transported from storage and fed into a powder or tablet manufacturing facility. Flow problems arise due to several causes. For dispersants, poor flow can be due to theirs hygroscopic properties.

Another problem associated with unit-dose products, in particular with water-soluble packs comprising a cleaning composition and an enveloping material is the interaction between the cleaning composition and the enveloping material. The enveloping material is water-soluble and usually contains a certain amount of water thus the presence of water in the cleaning composition could affect the integrity and properties of the film.

A further problem associated with multi-compartment unit dose products, is that the enveloping material is usually moisture permeable, allowing the transfer of moisture across compartments, negatively impacting on the stability of the product.

The objective of this invention is to provide a product that has a good environmental and cleaning profile, it is stable upon storage and it is favourable from a process viewpoint.

SUMMARY OF THE INVENTION

According to a first aspect of the invention there is provided a multi-compartment water-soluble pack. The pack comprises a cleaning composition, preferably an automatic dishwashing detergent composition and an enveloping material. The enveloping material is preferably a water-soluble film. Both the cleaning composition and the enveloping material are water-soluble. They readily dissolve when exposed to water in an automatic dishwashing process, preferably during the main wash.

The pack has at least two compartments. The first compartment contains a first composition in liquid form. Herein sometimes referred to as "first liquid". The first liquid comprises a hygroscopic material, preferably solubilised therein. The first liquid also comprises a high level of water. The water is partially or totally immobilized by the hygroscopic material providing great chemical stability to the cleaning composition and mechanical stability to the enveloping material.

The first liquid has a low equilibrium relative humidity (eRH) (less than about 65%, preferably less than about 60%, more preferably less than about 50% and especially less than about 40% as measured at 20° C.) and thereby low water activity that contributes to the stability of the pack. The eRH is measured as specified in the method detailed herein below.

In a preferred embodiment the product comprises a second compartment containing a second composition. The second composition comprises a moisture sensitive ingredient. Usually the first and second compositions contain different levels of water, however, due to the water retention capacity of the first liquid the water difference does not seem to affect the moisture sensitive ingredient. An ingredient forming part of a cleaning composition is considered to be moisture-sensitive when it can be partially or fully degraded during storage by the interaction of moisture with the composition thereby decreasing the detergency activity of the ingredient as for example detergency bleach, enzymes, etc. The activity (i.e., cleaning capacity) of moisture sensitive ingredients can decrease during storage when the cleaning composition is exposed to moisture. The second composition can be in any physical form, for example, it can be a liquid, gel or paste or be a solid composition. Preferably the second composition is in solid form, this allows having a product with different actives in their native forms thereby simplifying the manufacture of the product.

In a preferred embodiment the compartments are in a superposed configuration, i.e., one above the other, thereby providing improved stability by reducing the area of the compartments directly exposed to the surrounding environment.

In a preferred embodiment the hygroscopic material is deliquescent. A "deliquescent" material is so good at water absorption that when it is left in dry form at ambient conditions it takes so much moisture that it dissolves and becomes liquid. Deliquescent materials provide benefits in terms of water binding thereby contributing to the stability of the pack.

Preferably the hygroscopic material is an organic material. Preferably the hygroscopic material is a dispersant, more preferably a salt of a carboxylic acid. Preferred carboxylic acid salts for use herein include organic polymers containing carboxylate monomers, carboxylates such as citrate, aminocarboxylates such as salts of MGDA, GLDA, etc. The hygroscopic material not only contributes to the stability of the pack but it is also an active ingredient in the cleaning process. Preferably, the first composition comprises from 10 to 60%, more preferably from 20 to 60% and especially from 30 to 60% by weight of hygroscopic material.

For environmental reasons the pack is preferably free of phosphate, i.e. the composition comprises less than 20, more preferably less than 10 especially less than 5 ppm by weight of the composition of phosphate.

In preferred embodiments the first composition has an ionic strength of at least about 15 moles/1, preferably 20 moles/1 and especially 30 moles/l at 20° C. During the course of this work, it has been found that higher ionic strength of the first liquid is associated with lower eRH.

Preferably the first liquid is a Newtonian fluid, this helps in terms of manufacture of the pack and in terms of solubility of the composition in the cleaning process. Alternatively, the first liquid can be shear thinning.

According to a second aspect of the invention there is provided a process for making a multi-compartment water-soluble pack comprising the step of forming and filing a first open compartment with a first liquid composition comprising a hygroscopic material in liquid form. This process is advantageous because it allows the use of hygroscopic materials in the form in which they are synthesized, avoiding the need of secondary process steps to convert the liquid hygroscopic material into a solid. This would involve not only drying the material but also secondary steps to convert the dried material into particles.

DETAILED DESCRIPTION OF THE INVENTION

Figure 1:
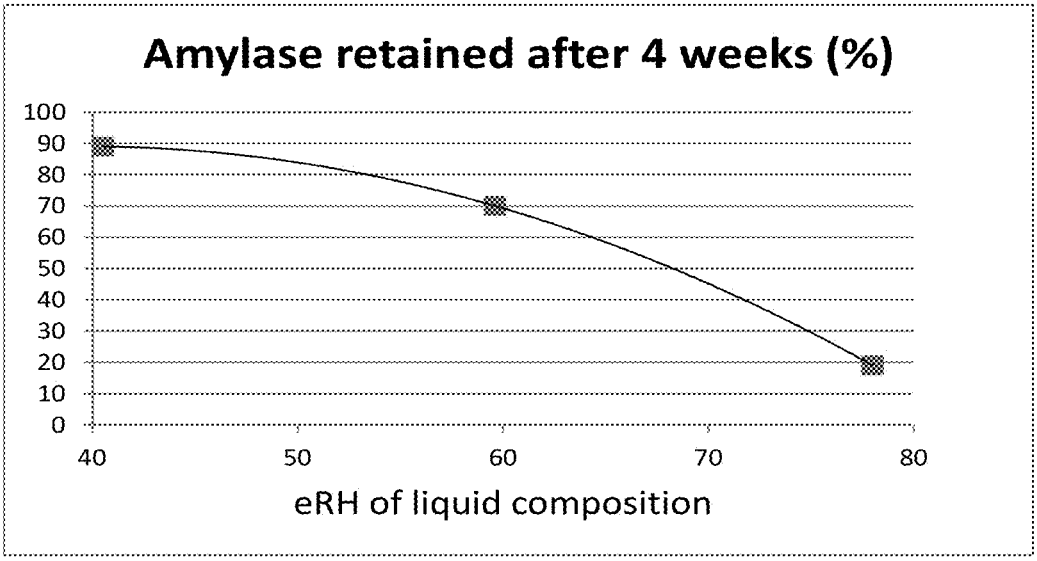
FIG. 1 is a plot of the percent amylase enzyme retained versus initial after storage for 4 weeks at 32 C and 80% relative humidity.

The present invention envisages a multi-compartment pack. By "multi-compartment pack" is herein meant a pack having at least two compartments, preferably at least three compartments, each compartment contains a composition surrounded by enveloping material. The compartments can be in any geometrical disposition. The different compartments can be adjacent to one another, preferably in contact with one another. Especially preferred configurations for use herein include superposed compartments (i.e. one above the other), side-by-side compartments, etc. Especially preferred from a view point of automatic dishwasher dispenser fitting, packaging optimisation and enveloping material reduction are multi-compartment packs having some superposed compartments and some side-by-side compartments.

The pack (sometimes herein also referred as "pouch") comprises a "cleaning composition", preferably an automatic dishwashing detergent composition. The cleaning composition is formed by either a plurality of partial or a plurality of complete cleaning compositions, i.e., the first, second and/or any subsequent compositions can be a complete cleaning composition or a partial composition that in combination with the remaining compositions in the pack forms the cleaning composition.

The pack has a first compartment, said compartment contains a first composition. The first composition is in liquid form, preferably an aqueous composition. It comprises more than about 15%, preferably more than 20%, more preferably more than 30% and especially more than 40% by weight of the first composition of water. Preferably, the hygroscopic material is solubilised therein.

Water can be measured by using Karl Fischer titration, after the pack has been conditioned by subjecting it to a relative humidity of 60%, at 20° C. for two weeks.

The first composition has an eRH of less than 65% as measured at 20° C., preferably less than 60%, more preferably less than 50% and especially less than 40% and more than 5% The pack presents a good stability profile (including chemical stability of the cleaning composition and mechanical stability of the enveloping material) and at the same time provides good cleaning.

Equilibrium relative humidity "eRH" measures the vapour pressure generated by the moisture present in a composition. It can be expressed as:

$$eRH=100\times Aw$$

Wherein Aw is water activity:

$$Aw=p/ps, \text{ where:}$$

p: partial pressure of water vapour at the surface of the composition.

ps: saturation pressure, or the partial pressure of water vapour above pure water at the composition temperature.

Water activity reflects the active part of moisture content or the part which, under the established conditions (20° C.), can be exchanged between a composition and its environment.

The eRH is measured after the pack has been conditioned by subjecting it to 60% relative humidity at 20° C. for two weeks.

For the purpose of this invention all the measurements are taken at atmospheric pressure unless stated otherwise.

The eRH can be measured using any commercially available equipment, such as a water activity meter (Rotronic A2101).

Hygroscopic Material

For the purpose of this invention, a "hygroscopic material" means a material is capable of absorbing moisture from the environment, for example, a material taking more than 0.5%, preferably more than 1% and even more preferably more than 10% of water by weight of the material at 80%, preferably 60% relative humidity and 20° C. within 48 hours. The hygroscopic material of the pack of the invention binds water thereby contributing to the stability of the pack.

Preferably the hygroscopic material of the invention is an organic material, more preferably acts as a dispersant in a cleaning process, in particular in an automatic dishwashing process.

By "dispersant" herein is meant any material capable of dispersing (i.e. maintain suspended or solubilised in the cleaning liquor) either metallic ions, such as calcium, iron, and any other metallic ions found in a cleaning liquor and/or soils found in the liquor. In the case of dishwashing, more in particular automatic dishwashing, the dispersant helps to avoid the deposition of scale and re-deposition of soils on the washed items thereby contributing to provide good drying and at the same time lack of filming and spotting on the washed objects, resulting on improved shine.

Preferred dispersants are selected from the group of organic polymers, organic builders and mixtures thereof. Preferred organic polymers are carboxylated polymers, more preferably polymers containing sulfonated groups.

Preferred organic builders for use herein include the salts of aminocarboxylic acid such as MGDA, GLDA and IDS, carboxymethyl inulin, citric acid and mixtures thereof, salts of GLDA are specially preferred for use herein. These organic builders have good dispersant properties and at the same time present a good environmental profile and greatly contribute to the stability of the pack. In the case of automatic dishwashing, the dispersant contribute to good cleaning, finishing and improved drying.

Specially preferred for use herein are compositions comprising both organic polymers and organic builders.

Preferably the hygroscopic material is a deliquescent material. A deliquescent material is a hygroscopic material which has a strong affinity for moisture and that turns from solid into fluid when it absorbs moisture. A deliquescent solid material becomes liquid above a certain relative humidity.

"By "deliquescent" material is herein meant a solid material that when in a mono-layer disposition exposed to a relative humidity of 80% and a temperature of 32° C. becomes liquid in less than a week, preferably within two days. In particular, whether a material is deliquescent or not it can be tested by placing 1 g of the solid material in a Petri dish of 5 cm diameter, the material should be placed in the form of a monolayer. The material would turn into liquid when subjected at a humidity of 80% and a temperature of 32° C. for one week.

Preferably the hygroscopic material is highly soluble in water. Preferably the hygroscopic material has a solubility at 20° C. greater than 500, more preferably greater than 800 and especially greater than 1000 g/l.

Preferably the hygroscopic material has an ionic strength at saturation of at least 15, more preferably at least 20 and specially at least 30 moles/l at 20° C.

Ionic strength is calculated from the molal concentration (m) of each ionic species present in solution and the charge (z) carried by each ionic species. Ionic strength (I) is one half the summation of $m \cdot z^2$ for all ionic species present i.e.

$$I = \tfrac{1}{2}\Sigma m \cdot z^2$$

For a salt whose ions are both univalent, ionic strength is the same as the molar concentration. This is not so where more than two ions or multiple charges are involved. For instance a 1 molar solution of sodium carbonate contains 2 mole/liter of sodium ions and 1 mole/liter of carbonate ions carrying a double charge. Ionic strength is given by:

$$I = \tfrac{1}{2}[2(1^2)+1\times(2^2)] = 3 \text{ moles/liter}$$

Preferably the hygroscopic material has a dual functionality. Not only acts as a water binder but also acts as a dispersant in the cleaning process in which the pack of the invention is used.

Organic Builders

Preferred organic builders include aminocarboxylate builders such as salts of MGDA (methyl-glycine-diacetic acid), GLDA (glutamic-N,N-diacetic acid), iminodisuccinic acid (IDS) and carboxymethyl inulin. Salts of MGDA and GLDA, more in particular salts of GLDA are especially preferred herein, with the tri-sodium salt thereof being preferred and a sodium/potassium salt being specially preferred for the favourable hygroscopicity and fast dissolution properties when in particulate form.

Other suitable aminocarboxylate builders include; for example, salts of aspartic acid-N-monoacetic acid (ASMA), aspartic acid-N,N-diacetic acid (ASDA), aspartic acid-N-monopropionic acid (ASMP), iminodisuccinic acid (IDA), N-(2-sulfomethyl) aspartic acid (SMAS), N-(2-sulfoethyl) aspartic acid (SEAS), N-(2-sulfomethyl) glutamic acid (SMGL), N-(2-sulfoethyl) glutamic acid (SEGL) and IDS (iminodiacetic acid) such as salts of N-methyliminodiacetic acid (MIDA), alpha-alanine-N,N-diacetic acid (alpha-ALDA), serine-N,N-diacetic acid (SEDA), isoserine-N,N-diacetic acid (ISDA), phenylalanine-N,N-diacetic acid (PHDA), anthranilic acid-N,N-diacetic acid (ANDA), sulfanilic acid-N, N-diacetic acid (SLDA), taurine-N,N-diacetic acid (TUDA) and sulfomethyl-N,N-diacetic acid (SMDA).

In addition to the aminocarboxylate builders the composition can comprise carbonate and/or citrate.

Preferably organic builders are present in an amount of from 10% to 70%, more preferably up to 45%, even more preferably up to 40%, and especially up to 35% by weight of the composition.

Organic Polymer

The polymer, if present, is used in any suitable amount from about 0.1% to about 30%, preferably from 0.5% to about 20%, more preferably from 1% to 15% by weight of the composition. Sulfonated/carboxylated polymers are particularly suitable for the composition of the invention.

Suitable sulfonated/carboxylated polymers described herein may have a weight average molecular weight of less than or equal to about 100,000 Da, or less than or equal to about 75,000 Da, or less than or equal to about 50,000 Da, or from about 3,000 Da to about 50,000, preferably from about 5,000 Da to about 45,000 Da.

As noted herein, the sulfonated/carboxylated polymers may comprise (a) at least one structural unit derived from at least one carboxylic acid monomer having the general formula (I):

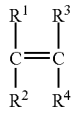

(I)

wherein $R^1$ to $R^4$ are independently hydrogen, methyl, carboxylic acid group or $CH_2COOH$ and wherein the carboxylic acid groups can be neutralized; (b) optionally, one or more structural units derived from at least one nonionic monomer having the general formula (II):

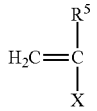

(II)

wherein $R^5$ is hydrogen, $C_1$ to $C_6$ alkyl, or $C_1$ to $C_6$ hydroxyalkyl, and X is either aromatic (with $R^5$ being hydrogen or methyl when X is aromatic) or X is of the general formula (III):

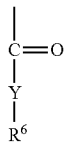

(III)

wherein $R^6$ is (independently of $R^5$) hydrogen, $C_1$ to $C_6$ alkyl, or $C_1$ to $C_6$ hydroxyalkyl, and Y is O or N; and at least one structural unit derived from at least one sulfonic acid monomer having the general formula (IV):

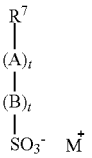

(IV)

wherein R7 is a group comprising at least one sp2 bond, A is O, N, P, S or an amido or ester linkage, B is a mono- or polycyclic aromatic group or an aliphatic group, each t is independently 0 or 1, and M+ is a cation. In one aspect, R7 is a C2 to C6 alkene. In another aspect, R7 is ethene, butene or propene.

Preferred carboxylic acid monomers include one or more of the following: acrylic acid, maleic acid, itaconic acid, methacrylic acid, or ethoxylate esters of acrylic acids, acrylic and methacrylic acids being more preferred. Preferred sulfonated monomers include one or more of the following: sodium(meth)allyl sulfonate, vinyl sulfonate, sodium phenyl(meth)allyl ether sulfonate, or 2-acrylamidomethyl propane sulfonic acid. Preferred non-ionic monomers include one or more of the following: methyl(meth) acrylate, ethyl(meth)acrylate, t-butyl(meth)acrylate, methyl (meth)acrylamide, ethyl(meth)acrylamide, t-butyl(meth) acrylamide, styrene, or α-methyl styrene.

Preferably, the polymer comprises the following levels of monomers: from about 40 to about 90%, preferably from about 60 to about 90% by weight of the polymer of one or more carboxylic acid monomer; from about 5 to about 50%, preferably from about 10 to about 40% by weight of the polymer of one or more sulfonic acid monomer; and optionally from about 1% to about 30%, preferably from about 2 to about 20% by weight of the polymer of one or more non-ionic monomer. An especially preferred polymer comprises about 70% to about 80% by weight of the polymer of at least one carboxylic acid monomer and from about 20% to about 30% by weight of the polymer of at least one sulfonic acid monomer.

The carboxylic acid is preferably (meth)acrylic acid. The sulfonic acid monomer is preferably one of the following: 2-acrylamido methyl-1-propanesulfonic acid, 2-methacrylamido-2-methyl-1-propanesulfonic acid, 3-methacrylamido-2-hydroxypropanesulfonic acid, allysulfonic acid, methallysulfonic acid, allyloxybenzenesulfonic acid, methallyloxybenzensulfonic acid, 2-hydroxy-3-(2-propenyloxy) propanesulfonic acid, 2-methyl-2-propene-1-sulfonic acid, styrene sulfonic acid, vinylsulfonic acid, 3-sulfopropyl acrylate, 3-sulfopropyl methacrylate, sulfomethylacrylamid, sulfomethylmethacrylamide, and water soluble salts thereof. The unsaturated sulfonic acid monomer is most preferably 2-acrylamido-2-propanesulfonic acid (AMPS).

Preferred commercial available polymers include: Alcosperse 240, Aquatreat AR 540 and Aquatreat MPS supplied by Alco Chemical; Acumer 3100, Acumer 2000, Acusol 587G and Acusol 588G supplied by Dow; Goodrich K-798, K-775 and K-797 supplied by BF Goodrich; and ACP 1042 supplied by ISP technologies Inc. Particularly preferred polymers are Acusol 587G and Acusol 588G supplied by Dow.

In the polymers, all or some of the carboxylic or sulfonic acid groups can be present in neutralized form, i.e. the acidic hydrogen atom of the carboxylic and/or sulfonic acid group in some or all acid groups can be replaced with metal ions, preferably alkali metal ions and in particular with sodium ions.

Other suitable organic polymer for use herein includes a polymer comprising an acrylic acid backbone and alkoxylated side chains, said polymer having a molecular weight of from about 2,000 to about 20,000, and said polymer having from about 20 wt % to about 50 wt % of an alkylene oxide. The polymer should have a molecular weight of from about 2,000 to about 20,000, or from about 3,000 to about 15,000, or from about 5,000 to about 13,000. The alkylene oxide (AO) component of the polymer is generally propylene oxide (PO) or ethylene oxide (EO) and generally comprises from about 20 wt % to about 50 wt %, or from about 30 wt % to about 45 wt %, or from about 30 wt % to about 40 wt % of the polymer. The alkoxylated side chains of the water soluble polymers may comprise from about 10 to about 55 AO units, or from about 20 to about 50 AO units, or from about 25 to 50 AO units. The polymers, preferably water soluble, may be configured as random, block, graft, or other known configurations. Methods for forming alkoxylated acrylic acid polymers are disclosed in U.S. Pat. No. 3,880,765.

Other suitable polymers for use herein include homopolymers and copolymers of polycarboxylic acids and their partially or completely neutralized salts, monomeric polycarboxylic acids and hydroxycarboxylic acids and their salts. Preferred salts of the abovementioned compounds are the ammonium and/or alkali metal salts, i.e. the lithium, sodium, and potassium salts, and particularly preferred salts are the sodium salts.

Suitable polycarboxylic acids are acyclic, alicyclic, heterocyclic and aromatic carboxylic acids, in which case they contain at least two carboxyl groups which are in each case separated from one another by, preferably, no more than two carbon atoms. Polycarboxylates which comprise two carboxyl groups include, for example, water-soluble salts of, malonic acid, (ethyl enedioxy)diacetic acid, maleic acid, diglycolic acid, tartaric acid, tartronic acid and fumaric acid. Polycarboxylates which contain three carboxyl groups include, for example, water-soluble citrate. Correspondingly, a suitable hydroxycarboxylic acid is, for example, citric acid. Another suitable polycarboxylic acid is the homopolymer of acrylic acid. Other suitable builders are disclosed in WO 95/01416, to the contents of which express reference is hereby made.

Other suitable organic polymer for use herein includes polyaspartic acid (PAS) derivatives as described in WO 2009/095645 A1.

Enveloping Material

The enveloping material is water soluble. By "water-soluble" is herein meant that the material has a water-solubility of at least 50%, preferably at least 75% or even at least 95%, as measured by the method set out herein after using a glass-filter with a maximum pore size of 20 microns.

50 grams+−0.1 gram of enveloping material is added in a pre-weighed 400 ml beaker and 245 ml+−1 ml of distilled water is added. This is stirred vigorously on a magnetic stirrer set at 600 rpm, for 30 minutes. Then, the mixture is filtered through a folded qualitative sintered-glass filter with a pore size as defined above (max, 20 micron). The water is dried off from the collected filtrate by any conventional method, and the weight of the remaining material is determined (which is the dissolved or dispersed faction). Then, the % solubility can be calculated.

The enveloping material is any water-soluble material capable of enclosing the cleaning composition of the product of the invention. The enveloping material can be a polymer that has been injection moulded to provide a casing or it can be a film. Preferably the enveloping material is made of polyvinyl alcohol. Preferably the enveloping material is a water-soluble film.

The pack can, for example, be obtained by injection moulding or by creating compartments using a film. The enveloping material is usually moisture permeable. The product of the invention is stable even when the enveloping material is moisture permeable. The first composition confers stability to the product, in terms of both interaction among the different compositions and interaction with the surrounding environment.

The enveloping material can be subjected to mechanical changes when exposed to moisture. The enveloping material can become brittle or too stretching when subjected to different moisture exposure conditions. The first composition contributes to the stabilization of the enveloping material.

Preferred substances for making the enveloping material include polymers, copolymers or derivatives thereof selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. More preferred polymers are selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, and most preferably selected from polyvinyl alcohols, polyvinyl alcohol copolymers and hydroxypropyl methyl cellulose (HPMC), and combinations thereof. Especially preferred for use herein is polyvinyl alcohol and even more preferred polyvinyl alcohol films.

Most preferred enveloping materials are PVA films known under the trade reference Monosol M8630, as sold by Chris-Craft Industrial Products of Gary, Ind., US, and PVA films of corresponding solubility and deformability characteristics. Other films suitable for use herein include films known under the trade reference PT film or the K-series of films supplied by Aicello, or VF-HP film supplied by Kuraray.

The enveloping material herein may comprise other additive ingredients than the polymer or polymer material and water. For example, it may be beneficial to add plasticisers, for example glycerol, ethylene glycol, diethyleneglycol, propylene glycol, sorbitol and mixtures thereof. Preferably the enveloping material comprises glycerol as plasticisers. Other useful additives include disintegrating aids.

Cleaning Composition

As described herein above the cleaning composition can be formed by partial compositions or each of the compositions of the pack can be a fully formulated cleaning compositions. The first compartment comprises a hygroscopic material. Preferred packs according to the invention comprises an aminocarboxylic acid, in particular GLDA and/or salts thereof as hygroscopic material. In preferred embodiment the pack comprises a second composition comprising bleach and enzymes, the second composition is preferably in solid form.

The following actives can be used in the pack of the invention, in any of the compositions.

Bleach System

Inorganic and organic bleaches are suitable for use herein. Inorganic bleaches include perhydrate salts such as perborate, percarbonate, perphosphate, persulfate and persilicate salts. The inorganic perhydrate salts are normally the alkali metal salts. The inorganic perhydrate salt may be included as the crystalline solid without additional protection. Alternatively, the salt can be coated.

Alkali metal percarbonates, particularly sodium percarbonate is the preferred bleach for use herein. The percarbonate is most preferably incorporated into the products in a coated form which provides in-product stability.

Potassium peroxymonopersulfate is another inorganic perhydrate salt of utility herein.

Typical organic bleaches are organic peroxyacids, especially diperoxydodecanedioc acid, diperoxytetradecanedioc acid, and diperoxyhexadecanedioc acid. Mono- and diperazelaic acid, mono- and diperbrassylic acid are also suitable herein. Diacyl and Tetraacylperoxides, for instance dibenzoyl peroxide and dilauroyl peroxide, are other organic peroxides that can be used in the context of this invention.

Further typical organic bleaches include the peroxyacids, particular examples being the alkylperoxy acids and the arylperoxy acids. Preferred representatives are (a) peroxybenzoic acid and its ring-substituted derivatives, such as alkylperoxybenzoic acids, but also peroxy-α-naphthoic acid and magnesium monoperphthalate, (b) the aliphatic or substituted aliphatic peroxy acids, such as peroxylauric acid, peroxystearic acid, ε-phthalimidoperoxycaproic acid[phthaloiminoperoxyhexanoic acid (PAP)], o-carboxybenzamidoperoxycaproic acid, N-nonenylamidoperadipic acid and N-nonenylamidopersuccinates, and (c) aliphatic and araliphatic peroxydicarboxylic acids, such as 1,12-diperoxycarboxylic acid, 1,9-diperoxyazelaic acid, diperoxysebacic acid, diperoxybrassylic acid, the diperoxyphthalic acids, 2-decyldiperoxybutane-1,4-dioic acid, N,N-terephthaloyldi(6-aminopercaproic acid).

Preferably, the level of bleach in the composition of the invention is from about 1 to about 20%, more preferably from about 2 to about 15%, even more preferably from about 3 to about 12% and especially from about 4 to about 10% by weight of the composition. Preferably the second composition comprises bleach.

Bleach Activators

Bleach activators are typically organic peracid precursors that enhance the bleaching action in the course of cleaning at temperatures of 60° C. and below. Bleach activators suitable for use herein include compounds which, under perhydrolysis conditions, give aliphatic peroxoycarboxylic acids having preferably from 1 to 12 carbon atoms, in particular from 2 to 10 carbon atoms, and/or optionally substituted perbenzoic acid. Suitable substances bear O-acyl and/or N-acyl groups of the number of carbon atoms specified and/or optionally substituted benzoyl groups. Preference is given to polyacylated alkylenediamines, in particular tetraacetylethylenediamine (TAED), acylated triazine derivatives, in particular 1,5-diacetyl-2,4-dioxohexahydro-1,3,5-triazine (DADHT), acylated glycolurils, in particular tetraacetylglycoluril (TAGU), N-acylimides, in particular N-nonanoylsuccinimide (NOSI), acylated phenolsulfonates, in particular n-nonanoyl- or isononanoyloxybenzenesulfonate (n- or iso-NOBS), decanoyloxybenzoic acid (DOBA), carboxylic anhydrides, in particular phthalic anhydride, acylated polyhydric alcohols, in particular triacetin, ethylene glycol diacetate and 2,5-diacetoxy-2,5-dihydrofuran and also triethylacetyl citrate (TEAC). Bleach activators if included in the compositions of the invention are in a level of from about 0.01 to about 10%, preferably from about 0.1 to about 5% and more preferably from about 1 to about 4% by weight of the total composition. If the composition comprises bleach activator then the bleach activator is preferentially placed in the second composition.

Bleach Catalyst

The composition herein preferably contains a bleach catalyst, preferably a metal containing bleach catalyst. More preferably the metal containing bleach catalyst is a transition metal containing bleach catalyst, especially a manganese or cobalt-containing bleach catalyst.

Bleach catalysts preferred for use herein include the manganese triazacyclononane and related complexes (U.S. Pat. No. 5,246,612, U.S. Pat. No. 5,227,084); Co, Cu, Mn and Fe bispyridylamine and related complexes (U.S. Pat. No. 5,114,611); and pentamine acetate cobalt(III) and related complexes(U.S. Pat. No. 4,810,410). A complete description of bleach catalysts suitable for use herein can be found in WO 99/06521, pages 34, line 26 to page 40, line 16.

Manganese bleach catalysts are preferred for use in the composition of the invention. Especially preferred catalyst for use here is a dinuclear manganese-complex having the general formula:

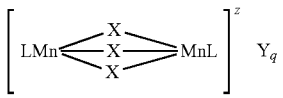

wherein Mn is manganese which can individually be in the III or IV oxidation state; each x represents a coordinating or bridging species selected from the group consisting of H2O, O22-, O2-, OH—, HO2-, SH—, S2-, >SO, Cl—, N3-, SCN—, RCOO—, NH2- and NR3, with R being H, alkyl or aryl, (optionally substituted); L is a ligand which is an organic molecule containing a number of nitrogen atoms which coordinates via all or some of its nitrogen atoms to the manganese centres; z denotes the charge of the complex and is an integer which can be positive or negative; Y is a monovalent or multivalent counter-ion, leading to charge neutrality, which is dependent upon the charge z of the complex; and q=z/[charge Y].

Preferred manganese-complexes are those wherein x is either $CH_3COO^-$ or $O^2$ or mixtures thereof, most preferably wherein the manganese is in the IV oxidation state and x is $O^{2-}$. Preferred ligands are those which coordinate via three nitrogen atoms to one of the manganese centres, preferably being of a macrocyclic nature. Particularly preferred ligands are:

(1) 1,4,7-trimethyl-1,4,7-triazacyclononane, (Me-TACN); and (2) 1,2,4,7-tetramethyl-1,4,7-triazacyclononane, (Me-Me TACN).

The type of counter-ion Y for charge neutrality is not critical for the activity of the complex and can be selected from, for example, any of the following counter-ions: chloride; sulphate; nitrate; methylsulphate; surfactant anions, such as the long-chain alkylsulphates, alkylsulphonates, alkylbenzenesulphonates, tosylate, trifluoromethylsulphonate, perchlorate ($ClO_4^-$), $BPh_4^-$, and $PF_6^-$, though some counter-ions are more preferred than others for reasons of product property and safety.

Consequently, the preferred manganese complexes useable in the present invention are:

$$[(\text{Me-TACN})Mn^{IV}(\text{Âμ–0})_3Mn^{IV}(\text{Me-TACN})]^{2+}(PF_6^-)_2 \quad (I)$$

$$[(\text{Me-MeTACN})Mn^{IV}(\text{Âμ–0})_3Mn^{IV}(\text{Me-MeTACN})]^{2+}(PF_6^-)_2 \quad (II)$$

$$[(\text{Me-TACN})Mn^{III}(\text{Âμ–0})(\text{Âμ-OAc})_2Mn^{III}(\text{Me-TACN})]^{2+}(PF_6^-)_2 \quad (III)$$

$$[(\text{Me-MeTACN})Mn^{III}(\text{Âμ–0})(\text{Âμ-OAc})_2Mn^{III}(\text{Me-MeTACN})]^{2+}(PF_6^-)_2 \quad (IV)$$

which hereinafter may also be abbreviated as:

$$[Mn^{IV}{}_2(\text{Âμ–0})_3(\text{Me-TACN})_2](PF_6)_2 \quad (I)$$

$$[Mn^{IV}{}_2(\text{Âμ–0})_3(\text{Me-MeTACN})_2](PF_6)_2 \quad (II)$$

$$[Mn^{III}{}_2(\text{Âμ–0})(\text{Âμ-OAc})_2(\text{Me-TACN})_2](PF_6)_2 \quad (III)$$

$$[Mn^{III}{}_2(\text{Âμ–0})(\text{Âμ-OAc})_2(\text{Me-TACN})_2](PF_6)_2 \quad (IV)$$

The structure of I is given below:

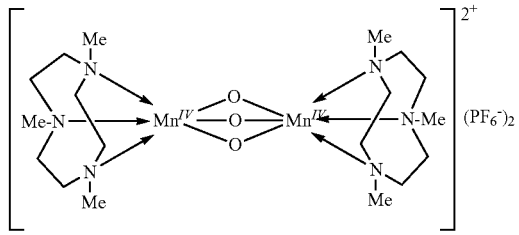

abbreviated as $[Mn^{IV}{}_2(\text{Âμ–0})_3(\text{Me-TACN})_2](PF_6)_2$.

The structure of II is given below:

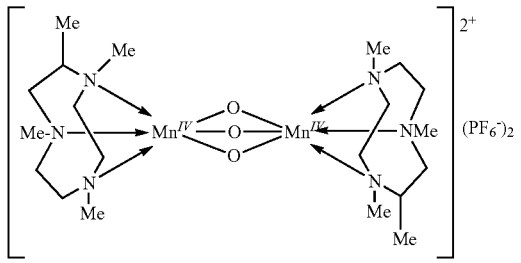

abbreviated as $[Mn^{IV}_2(\hat{A}\mu\text{–}0)_3(Me\text{-}MeTACN)_2](PF_6)_2$.

It is of note that the manganese complexes are also disclosed in EP-A-0458397 and EP-A-0458398 as unusually effective bleach and oxidation catalysts. In the further description of this invention they will also be simply referred to as the "catalyst".

Bleach catalyst are included in the compositions of the invention are in a preferred level of from about 0.001 to about 10%, preferably from about 0.05 to about 2% by weight of the total composition.

Surfactant

Surfactants suitable for use herein include non-ionic surfactants, preferably the compositions are free of any other surfactants. Traditionally, non-ionic surfactants have been used in automatic dishwashing for surface modification purposes in particular for sheeting to avoid filming and spotting and to improve shine. It has been found that non-ionic surfactants can also contribute to prevent redeposition of soils.

Preferably the composition of the invention comprises a non-ionic surfactant or a non-ionic surfactant system, more preferably the non-ionic surfactant or a non-ionic surfactant system has a phase inversion temperature, as measured at a concentration of 1% in distilled water, between 40 and 70° C., preferably between 45 and 65° C. By a "non-ionic surfactant system" is meant herein a mixture of two or more non-ionic surfactants. Preferred for use herein are non-ionic surfactant systems. They seem to have improved cleaning and finishing properties and better stability in product than single non-ionic surfactants.

Phase inversion temperature is the temperature below which a surfactant, or a mixture thereof, partitions preferentially into the water phase as oil-swollen micelles and above which it partitions preferentially into the oil phase as water swollen inverted micelles. Phase inversion temperature can be determined visually by identifying at which temperature cloudiness occurs.

The phase inversion temperature of a non-ionic surfactant or system can be determined as follows: a solution containing 1% of the corresponding surfactant or mixture by weight of the solution in distilled water is prepared. The solution is stirred gently before phase inversion temperature analysis to ensure that the process occurs in chemical equilibrium. The phase inversion temperature is taken in a thermostable bath by immersing the solutions in 75 mm sealed glass test tube. To ensure the absence of leakage, the test tube is weighed before and after phase inversion temperature measurement. The temperature is gradually increased at a rate of less than 1° C. per minute, until the temperature reaches a few degrees below the pre-estimated phase inversion temperature. Phase inversion temperature is determined visually at the first sign of turbidity.

Suitable nonionic surfactants include: i) ethoxylated nonionic surfactants prepared by the reaction of a monohydroxy alkanol or alkyphenol with 6 to 20 carbon atoms with preferably at least 12 moles particularly preferred at least 16 moles, and still more preferred at least 20 moles of ethylene oxide per mole of alcohol or alkylphenol; ii) alcohol alkoxylated surfactants having a from 6 to 20 carbon atoms and at least one ethoxy and propoxy group. Preferred for use herein are mixtures of surfactants i) and ii).

Another suitable non-ionic surfactants are epoxy-capped poly(oxyalkylated) alcohols represented by the formula:

$$R1O[CH2CH(CH3)O]_x[CH2CH2O]_y[CH2CH(OH)R2] \quad (I)$$

wherein R1 is a linear or branched, aliphatic hydrocarbon radical having from 4 to 18 carbon atoms; R2 is a linear or branched aliphatic hydrocarbon radical having from 2 to 26 carbon atoms; x is an integer having an average value of from 0.5 to 1.5, more preferably about 1; and y is an integer having a value of at least 15, more preferably at least 20.

Preferably, the surfactant of formula I, at least about 10 carbon atoms in the terminal epoxide unit [CH2CH(OH)R2]. Suitable surfactants of formula I, according to the present invention, are Olin Corporation's POLY-TERGENT® SLF-18B nonionic surfactants, as described, for example, in WO 94/22800, published Oct. 13, 1994 by Olin Corporation.

Amine oxides surfactants are useful for use in the composition of the invention. Preferred are C10-C18 alkyl dimethylamine oxide, and C10-18 acylamido alkyl dimethylamine oxide.

Surfactants may be present in amounts from 0 to 15% by weight, preferably from 0.1% to 10%, and most preferably from 0.25% to 8% by weight of the total composition.

Enzymes

In describing enzyme variants herein, the following nomenclature is used for ease of reference: Original amino acid(s):position(s):substituted amino acid(s). Standard enzyme IUPAC 1-letter codes for amino acids are used.

Proteases

Suitable proteases include metalloproteases and serine proteases, including neutral or alkaline microbial serine proteases, such as subtilisins (EC 3.4.21.62) as well as chemically or genetically modified mutants thereof. Suitable proteases include subtilisins (EC 3.4.21.62), including those derived from *Bacillus*, such as *Bacillus lentus, B. alkalophilus, B. subtilis, B. amyloliquefaciens, Bacillus pumilus* and *Bacillus gibsonii.*

Especially preferred proteases for the detergent of the invention are polypeptides demonstrating at least 90%, preferably at least 95%, more preferably at least 98%, even more preferably at least 99% and especially 100% identity with the wild-type enzyme from *Bacillus lentus*, comprising mutations in one or more, preferably two or more and more preferably three or more of the following positions, using the BPN' numbering system and amino acid abbreviations as illustrated in WO00/37627, which is incorporated herein by reference: V68A, N87S, S99D, S99SD, S99A, S101G, S101M, S103A, V104N/I, G118V, G118R, S128L, P129Q, S130A, Y167A, R170S, A194P, V205I and/or M222S.

Most preferably the protease is selected from the group comprising the below mutations (BPN' numbering system) versus either the PB92 wild-type (SEQ ID NO:2 in WO 08/010925) or the subtilisin 309 wild-type (sequence as per PB92 backbone, except comprising a natural variation of N87S).

(i) G118V+S128L+P129Q+S130A (ii) S101M+G118V+S128L+P129Q+S130A (iii) N76D+N87R+G118R+S128L+P129Q+S130A+S188D+N248R (iv) N76D+N87R+G118R+S128L+P129Q+S130A+S188D+V244R (v) N76D+N87R+G118R+S128L+P129Q+S130A (vi) V68A+N87S+S101G+V104N Suitable commercially available protease enzymes include those sold under the trade names Savinase®, Polarzyme®, Kannase®, Ovozyme®, Everlase® and Esperase® by Novozymes A/S (Denmark), those sold under the tradename Properase®, Purafect®, Purafect Prime®, Purafect Ox®, FN3®, FN4®, Excellase®, Ultimase® and Purafect OXP® by Genencor International, those sold under the tradename Opticlean® and Optimase® by Solvay Enzymes, those available from Henkel/Kemira, namely BLAP.

Preferred levels of protease in the product of the invention include from about 0.1 to about 10, more preferably from about 0.5 to about 5 and especially from about 1 to about 4 mg of active protease per grams of product.

Amylases

Preferred enzyme for use herein includes alpha-amylases, including those of bacterial or fungal origin. Chemically or genetically modified mutants (variants) are included. A preferred alkaline alpha-amylase is derived from a strain of *Bacillus*, such as *Bacillus licheniformis, Bacillus amyloliquefaciens, Bacillus stearothermophilus, Bacillus subtilis*, or other *Bacillus* sp., such as *Bacillus* sp. NCIB 12289, NCIB 12512, NCIB 12513, DSM 9375 (U.S. Pat. No. 7,153,818) DSM 12368, DSMZ no. 12649, KSM AP1378 (WO 97/00324), KSM K36 or KSM K38 (EP 1,022,334). Preferred amylases include:

(a) the variants described in U.S. Pat. No. 5,856,164 and WO99/23211, WO 96/23873, WO00/60060 and WO 06/002643, especially the variants with one or more substitutions in the following positions versus the AA560 enzyme listed as SEQ ID No. 12 in WO 06/002643:

9, 26, 30, 33, 82, 37, 106, 118, 128, 133, 149, 150, 160, 178, 182, 186, 193, 195, 202, 214, 231, 256, 257, 258, 269, 270, 272, 283, 295, 296, 298, 299, 303, 304, 305, 311, 314, 315, 318, 319, 320, 323, 339, 345, 361, 378, 383, 419, 421, 437, 441, 444, 445, 446, 447, 450, 458, 461, 471, 482, 484, preferably that also contain the deletions of D183* and G184*.

(b) variants exhibiting at least 95% identity with the wild-type enzyme from *Bacillus* sp. 707 (SEQ ID NO:7 in U.S. Pat. No. 6,093,562), especially those comprising one or more of the following mutations M202, M208, S255, R172, and/or M261. Preferably said amylase comprises one of M202L or M202T mutations.

Suitable commercially available alpha-amylases include DURAMYL®, LIQUEZYME®, TERMAMYL®, TERMAMYL ULTRA®, NATALASE®, SUPRAMYL®, STAINZYME®, STAINZYME PLUS®, POWERASE®, FUNGAMYL® and BAN® (Novozymes A/S, Bagsvaerd, Denmark), KEMZYM® AT 9000 Biozym Biotech Trading GmbH Wehlistrasse 27b A-1200 Wien Austria, RAPIDASE®, PURASTAR®, ENZYSIZE®, OPTISIZE HT PLUS® and PURASTAR OXAM® (Genencor International Inc., Palo Alto, Calif.) and KAM® (Kao, 14-10 Nihonbashi Kayabacho, 1-chome, Chuo-ku Tokyo 103-8210, Japan). Amylases especially preferred for use herein include NATALASE®, STAINZYME®, STAINZYME PLUS®, POWERASE® and mixtures thereof.

Additional Enzymes

Additional enzymes suitable for use in the product of the invention can comprise one or more enzymes selected from the group comprising hemicellulases, cellulases, cellobiose dehydrogenases, peroxidases, proteases, xylanases, lipases, phospholipases, esterases, cutinases, pectinases, mannanases, pectate lyases, keratinases, reductases, oxidases, phenoloxidases, lipoxygenases, ligninases, pullulanases, tannases, pentosanases, malanases, β-glucanases, arabinosidases, hyaluronidase, chondroitinase, laccase, amylases, and mixtures thereof.

Cellulases

The product of the invention preferably comprises other enzymes in addition to the protease and/or amylase. Cellulase enzymes are preferred additional enzymes, particularly microbial-derived endoglucanases exhibiting endo-beta-1,4-glucanase activity (E.C. 3.2.1.4). Preferred commercially available cellulases for use herein are Celluzyme®, Celluclean®, Whitezyme® (Novozymes A/S) and Puradax HA® and Puradax® (Genencor International).

Preferably, the product of the invention comprises at least 0.01 mg of active amylase per gram of composition, preferably from about 0.05 to about 10, more preferably from about 0.1 to about 6, especially from about 0.2 to about 4 mg of amylase per gram of composition.

Preferably, the protease and/or amylase of the product of the invention are in the form of granulates, the granulates comprise less than 29% of efflorescent material by weight of the granulate or the efflorescent material and the active enzyme (protease and/or amylase) are in a weight ratio of less than 4:1.

Metal Care Agents

Metal care agents may prevent or reduce the tarnishing, corrosion or oxidation of metals, including aluminium, stainless steel and non-ferrous metals, such as silver and copper. Preferably the composition of the invention comprises from 0.1 to 5%, more preferably from 0.2 to 4% and specially from 0.3 to 3% by weight of the composition of a metal care agent, preferably the metal care agent is a zinc salt.

Multi-Compartment Pack

A multi-compartment pack is formed by a plurality of water-soluble enveloping materials which form a plurality of compartments. The enveloping materials can have the same or different solubility profiles to allow controlled release of different ingredients. Preferably the enveloping material is a water-soluble polyvinyl alcohol film.

Preferred packs comprise superposed compartments. This disposition contributes to the compactness, robustness and strength of the pack, additionally, it minimise the amount of water-soluble material required. The robustness of the pack allows also for the use of very thin films without compromising the physical integrity of the pack. The pack is also very easy to use because the compartments do not need to be folded to be used in machine dispensers of fix geometry. As stated before, superposed configuration contributes to the chemical stability of the cleaning composition, the first composition helps to protect the second composition and the enveloping material from moisture.

Preferably, the second compartment contains a solid composition, more preferably in powder form. The second and first compositions are preferably in a weight ratio of from about 5:1 to about 1:5, more preferably from about 3:1 to about 1:2 and even more preferably from about 2:1 to about 1:1. This kind of pack is very versatile because it can accommodate compositions having a broad spectrum of values of solid:liquid ratio.

For dispenser fit reasons, especially in an automatic dishwasher, the packs herein have a square or rectangular base and a height of from about 1 to about 5 cm, more preferably from about 1 to about 4 cm. Preferably the weight of the solid composition is from about 5 to about 20 grams, more preferably from about 10 to about 18 grams and the weight of the liquid compositions is from about 0.5 to about 10 grams, more preferably from about 1 to about 5 grams.

The enveloping materials which form different compartments can have different solubility, under the same conditions, releasing the content of the compositions which they partially or totally envelope at different times.

Controlled release of the ingredients of a multi-compartment pouch can be achieved by modifying the thickness and/or the solubility of the enveloping material. The solubility of the enveloping material can be delayed by for example cross-linking the film as described in WO 02/102,955 at pages 17 and 18. Other enveloping materials, in particular water-soluble films designed for rinse release are described in U.S. Pat. No. 4,765,916 and U.S. Pat. No. 4,972,017. Waxy coating (see WO 95/29982) of films can help with rinse release. pH controlled release means are described in WO 04/111178, in particular amino-acetylated polysaccharide having selective degree of acetylation.

Other means of obtaining delayed release by multi-compartment packs with different compartments, where the compartments are made of films having different solubility are taught in WO 02/08380.

Examples

Multi-compartment water-soluble packs comprising an automatic dishwashing cleaning composition were made. The packs comprise a first compartment containing a liquid composition and a second compartment containing a solid composition. The solid composition comprises bleach and enzymes among other detergent ingredients. The first compartment (specific weight of liquids used can be found in the tables below) is superposed onto the second compartment (11.54 g). The enveloping material used was a polyvinyl alcohol water-soluble film, M8630 supplied by Monosol.

Closed zipped lock bags (outer PET/inner PE laminate) containing 15 pouches were prepared and stored for 4 weeks at 32° C. and 80% relative humidity at atmospheric pressure. Moisture interacts with the bleach which in turn oxidises the enzymes and reduces the amount left versus the freshly made pack. Bleach degradation contributes to a drop in retained enzymes. Enzyme retention is herein used to evaluate the chemical stability of the pouch.

Protease retention is measured through activity using N-Succinyl-ALA-ALA-PRO-PHE p-nitroanilide (PNA) as substrate. The mechanism for this chemistry is as follows: A solution of detergent/protease is introduced to the PNA substrate in solution. The enzyme cleaves bonds between amino acids and most importantly the amide bond between the phenylalanine and the p-nitroanilide group liberating p-nitroaniline, thus producing a yellow color. The intensity of the color (405 nm) is proportional to the amount of enzyme in the solution.

Amylase retention is measured through activity using the Infinity Amylase Kit. The Infinity method of amylase quantisation employs the use of a modified p-nitrophenylmaltoheptaside as a substrate containing a terminal glucose unit blocked with an ethylidene group. This terminal blocking inhibits cleavage by the α-glucosidase until the initial internal bonds can be cleaved by the α-amylase followed by glucoamylase. The increase in absorbance (405 nm) per minute, facilitated by the release of p-nitrophenol (pNP) by the α-glucosidase, is directly proportional to the α-amylase activity in the matrix.

All tested pouches were made with the same powder, only differing by the composition of the liquid. Comparative tests with packs containing a liquid composition with the same amount of water but without the hygroscopic material could not be made because the liquid would weaken the enveloping material and the pack would not last for the entire duration of the test.

Product Composition

| | Powder g per pouch |
|---|---|
| Granular Sodium Carbonate | 7.05 |
| Stainzyme plus | 0.13 |
| Ultimase | 0.34 |
| Bleach catalyst | 0.10 |
| Sodium Percarbonate | 1.87 |
| TAED | 0.65 |
| Acusol 588 | 1.29 |
| HEDP Sodium salt | 0.12 |
| Total powder weight | 11.54 |

| Liquid Composition 1 | % RM Parts | g per pouch |
|---|---|---|
| Lutensol TO7 | 4.72 | 0.31 |
| Water | 39.95 | 0.12 |
| Glycerine | 2.30 | 0.15 |
| Plurafac SLF180 | 19.23 | 1.25 |
| Tetra Na GLDA | 33.79 | 4.68 |
| Total | 100% | 6.51 g |

| Liquid Composition 2 | % RM Parts | g per pouch |
|---|---|---|
| Lutensol TO7 | 4.58 | 0.31 |
| Water | 41.80 | 0.12 |
| Glycerine | 2.23 | 0.15 |
| Plurafac SLF180 | 18.66 | 1.25 |
| Tri Na MGDA | 32.73 | 4.88 |
| Total | 100% | 6.71 g |

| Liquid Composition 3 | % RM Parts | g per pouch |
|---|---|---|
| Lutensol TO7 | 5.29 | 0.31 |
| Water | 27.43 | 0.12 |
| Glycerine | 2.58 | 0.15 |
| Plurafac SLF180 | 21.55 | 1.25 |
| Na $K_3$ GLDA | 43.16 | 3.98 |
| Total | 100% | 5.81 g |

The eRH of the each liquid was measured by placing freshly made liquid composition at room temperature (20+/−1 C) in a Rotronic Hygrolab moisture meter, (in a plastic sample liner of 14 mm depth) until full equilibrium is achieved.

Figure 2:
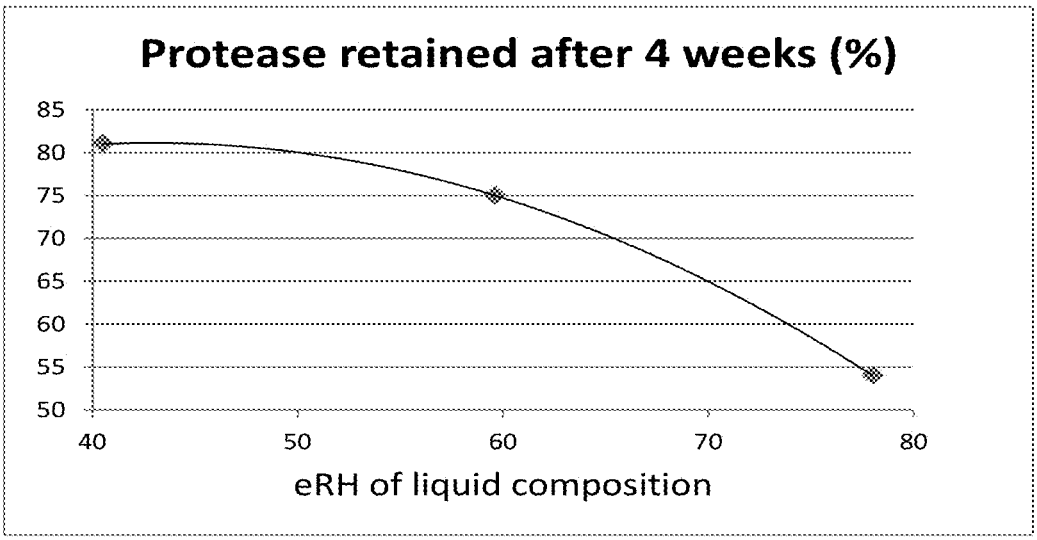
FIG. 2 is a plot of the percent protease enzyme retained versus initial after storage for 4 weeks at 32 C and 80% relative humidity.

The enzyme stability clearly improves at lower eRH values even when high amounts of water are present as shown in FIGS. 1 and 2.

| Enzyme retained versus initial after storage for 4 weeks at 32 C. and 80% relative humidity | Water % in liquid | eRH of liquid | Protease | Amylase |
|---|---|---|---|---|
| Liquid Composition 2 | 42 | 78.0 | 54% | 19% |
| Liquid Composition 1 | 40 | 59.6 | 75% | 70% |
| Liquid Composition 3 | 27 | 40.5 | 81% | 89% |

The mechanical properties of the enveloping material are practically unaffected during the four weeks storage test for compositions 1 and 3.

Abbreviations Used in the Example

In the example, the abbreviated component identifications have the following meanings:

Stainzyme plus: Amylase supplied by Novozymes

Ultimase Protease supplied by Dupont

TAED: Tetraacetylethylenediamine

Bleach catalyst: Pentaamine acetatocobalt (III) nitrate

Sodium carbonate: Anhydrous sodium carbonate

Acusol 588: Sulfonated polymer supplied by Dow Chemical

Lutensol TO7: Non-ionic surfactant supplied by BASF

Plurafac SLF180: Non-ionic surfactant supplied by BASF

HEDP: 1-hydroxyethyidene-1,1-diphosphonic acid

Tri Na MGDA: Tri sodium salt of methylglycinediacetic acid

Tetra NaGLDA Tetra sodium salt of glutamic acid N,N-diacetic acid

NaK3GLDA Sodium tri-potassium salt of glutamic acid N,N-diacetic acid

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to the term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A multi-compartment water-soluble pack comprising a cleaning composition and an enveloping material where the pack comprises a first compartment containing a first composition in liquid form and a second compartment containing a second composition, wherein the enveloping material comprises a polyvinyl alcohol film, wherein the first composition comprises:

i) a hygroscopic material, wherein the hygroscopic material is a glutamic-N,N-diacetic acid (GLDA) salt; and ii) more than about 15% of water;

wherein the first composition has an equilibrium relative humidity of less than about 65% at 20° C., wherein the second composition comprises an enzyme.

2. The pack according to claim 1, wherein the second composition is in solid form.

3. The pack according to claim 1, wherein the first and the second compartments are in a superposed configuration.

4. The pack according to claim 1, wherein the first composition comprises from about 5% to about 60% by weight of the hygroscopic material.

5. The pack according to claim 1, wherein the first and second compositions are free of phosphate.

6. The pack according to claim 1, wherein the first composition has an ionic strength of at least about 15 mol/l.

7. The pack according to claim 1, wherein the first composition is a Newtonian liquid.

8. The pack according to claim 1, wherein the first and second compositions are automatic dishwashing detergents.

* * * * *